US008647168B2

(12) United States Patent
Anvaripour

(10) Patent No.: US 8,647,168 B2
(45) Date of Patent: Feb. 11, 2014

(54) GARMENT FOR PROVIDING BODY SHAPING

(76) Inventor: Kiana Anvaripour, Santa Monica, CA (US)

( * ) Notice: Subject to any disclaimer, the term of this patent is extended or adjusted under 35 U.S.C. 154(b) by 3 days.

(21) Appl. No.: 13/018,433

(22) Filed: Feb. 1, 2011

(65) Prior Publication Data

US 2012/0196508 A1 Aug. 2, 2012

(51) Int. Cl.
*A41C 3/00* (2006.01)

(52) U.S. Cl.
USPC ..... 450/19; 450/8; 450/74; 2/73

(58) Field of Classification Search
USPC ..... 450/60–66, 30–33, 94–96, 110, 450/114–118, 122, 123, 130–132, 6–12, 450/19–21, 23; 2/73, 69, 67
See application file for complete search history.

(56) References Cited

U.S. PATENT DOCUMENTS

| | | | | |
|---|---|---|---|---|
| 2,875,763 | A * | 3/1959 | Marchisella | 450/8 |
| 2,934,071 | A * | 4/1960 | Child | 450/8 |
| 2,963,022 | A * | 12/1960 | Spetalnik | 450/15 |
| 3,110,313 | A * | 11/1963 | Plehn | 450/19 |
| 3,185,156 | A * | 5/1965 | Steinberger | 450/14 |
| 3,246,648 | A * | 4/1966 | Simon | 450/19 |
| 6,443,805 | B1 * | 9/2002 | Kirkwood | 450/31 |
| 7,395,557 | B1 * | 7/2008 | Ledyard | 2/113 |
| 7,546,751 | B2 * | 6/2009 | Lutz | 66/177 |
| 2002/0022433 | A1 * | 2/2002 | Yeung et al. | 450/70 |
| 2002/0152775 | A1 * | 10/2002 | Browder, Jr. | 66/170 |

* cited by examiner

*Primary Examiner* — Gloria Hale
(74) *Attorney, Agent, or Firm* — White-Welker & Welker, LLC; Matthew T. Welker, Esq.

(57) ABSTRACT

A garment for providing body shaping. In one embodiment, a slip-shaped body garment uses support bands to provide support in various areas of the body while maintaining an overall smooth and desirable body shape.

18 Claims, 13 Drawing Sheets

GARMENT FOR PROVIDING BODY SHAPING

FIELD OF THE INVENTION

The present disclosure pertains to the field of garments and fashion. More particularly, embodiments relate to a body garment for providing body shaping.

DESCRIPTION OF RELATED ART

Many body shaping garments are comprised of a substantially uniform or single set of materials to provide support and shaping of the body without regard to areas of the body that may need focused or more precise shaping. The result is a non-uniform or otherwise undesirable shaping of the body.

BRIEF DESCRIPTION OF THE FIGURES

The present invention is illustrated by way of example and not limitation in the Figures of the accompanying drawings.

DETAILED DESCRIPTION

Figure 1A:
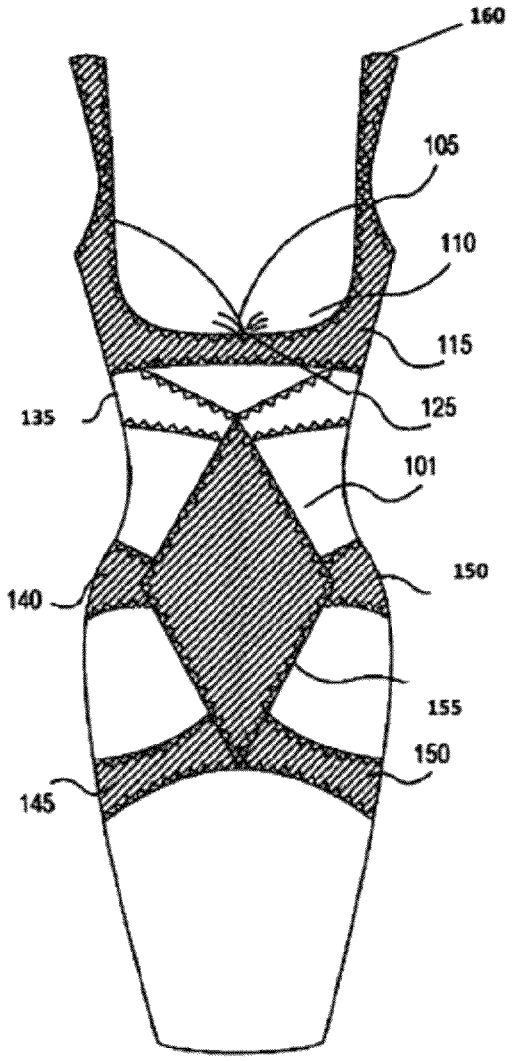
FIGS. 1*a*-1*b* illustrate a garment according to one embodiment.

The following description describes embodiments of a garment that may be used as a body-shaping garment and as fashionable lingerie. In one embodiment, the slip-shaped garment includes one or more bands that wrap around the circumference of the slip-shaped garment in a symmetric orientation around the body of the garment. In one embodiment, the one or more bands may be placed in areas of the slip intended to provide support and contour certain areas of the body, including the breasts, the waist, the hips, and the buttocks. In one embodiment, the one or more bands may be of a different type or thickness of material than other parts of the slip-shaped garment in order to provide better support and contour of the areas of the body to be supported by the bands. For example, in one embodiment, the bands are made of a flexible but durable fabric that can both stretch and support areas of the body while maintaining a substantially smooth overall contour in relation to other areas of the body covered by the slip-shaped garment.

In one embodiment, the slip-shaped garment includes a tummy guard that serves to both provide support and contouring of the stomach area while serving as a connecting point for at least some of the radial bands that wrap around the body, such that the radial bands can provide support to the stomach area in proportion to the amount they are stretched by other parts of the body, thereby maintaining proportion of the correspondingly supported parts of the body with respect to the stomach area. In one embodiment, the tummy guard is the same material and thickness as the other radial bands of the garment, whereas in other embodiments, the tummy guard is a different material or thickness than the other radial bands of the garment. In one embodiment, the slip-shaped garment includes a lifting bra with additional slits for breast enhancing pads. Embodiments generally provide a shaping undergarment that creates support, lift, and contouring of the body at one or more areas of the body that require it while serving as an elegant and pleasing article of lingerie.

The Bra Component

In one embodiment, the garment has a built-in bra that may include prior art brazier technology and material and may provide sizing and shaping without the use of an underwire, which can cause wearer discomfort and irritation. In one embodiment, the cup of the bra includes a mesh fabric to help shape and contour the breasts, and/or a band along the underside of the breasts that may be wide and circular for helping to lift and shape the breasts and create cleavage. In addition, wide bra straps may be used for maximum comfort and support. In one embodiment, the internal side of the bra component may include pockets with a slit-like opening that allows padding, such as gel or silicone, to be inserted. In one embodiment, the padding will be concealed and will stay in place when wearing only the slip-shaped garment.

The Zipper Component

Embodiments may include a zipper or may not. In one embodiment, in which a zipper is included in the back of the garment, the garment may be placed on the body without slipping the garment over one's head. Furthermore, a zipper may add an additional aesthetically pleasing aspect to undressing, particularly when assisted by another. Prior art body shaping garments typically don't combine the elements of lingerie and body-shaping.

The Body Shaping Component(s)

In one embodiment, the garment includes body shaping elements, including a diamond shaped stomach guard for providing support and flattening of the stomach constructed of three layers of mesh, heavy duty performance fabric, such as, what's commonly referred to as, "power mesh". In other embodiments, the stomach guard may be other shapes and include other materials or possess different supportive properties. In one embodiment, the stomach guard includes a top layer of power mesh this is cut approximately 40% smaller than other layers of the stomach guard, such that when stomach guard is sewn to the garment, the stomach guard pulls and flattens the stomach. In one embodiment, the stomach guard is positioned on the garment to both flatten the stomach and to provide a central point to which bands may be connected. In one embodiment, two bands may be connected to the stomach guard to form a "v" shape to support areas around the waist.

In other embodiments, other bands may be connected to the stomach guard in different orientations or positions. In one embodiment, the bands are stitched with a heavy duty zigzag pattern around the contour of the garment in order to promote durability and flexibility. Middle bands may wrap around the hips and connect to stomach guard to provide support and contouring of so called, "love handles". A third band may be connected to the stomach guard to shape and slim areas around the buttocks, referred to as "saddle bags".

Exemplary Embodiments

The following is a description of several exemplary embodiments. However, none of these examples, nor the figures to which they correspond, should be taken as complete set of examples or otherwise limiting the claims to any particular embodiment. The examples discussed herein are merely to illustrate various aspects of embodiments of the invention.

Figure 1B:
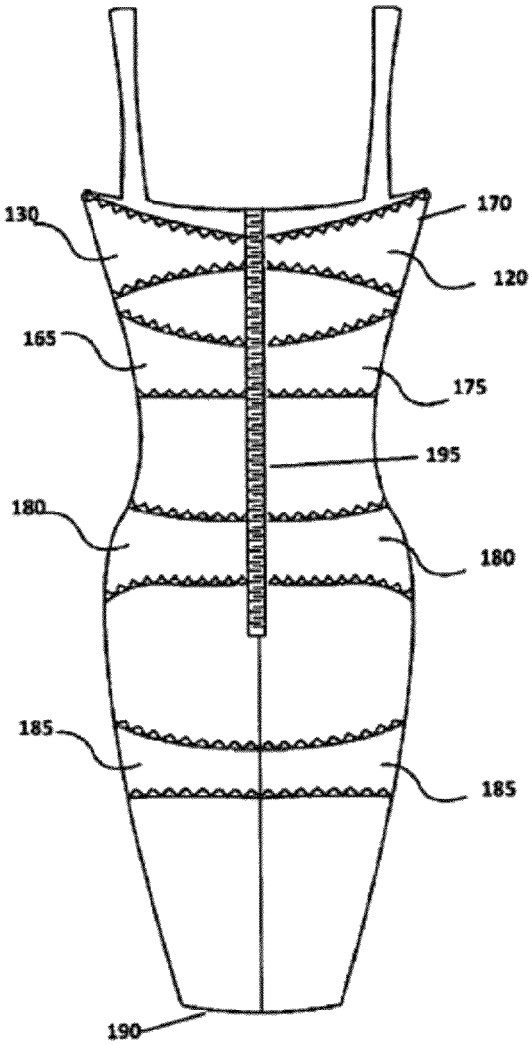

FIGS. 1*a*-1*b* illustrate a slip-shaped garment according to one embodiment. In one embodiment, a diamond shaped stomach guard 101 serves to help flatten the stomach of the wearer. In one embodiment the stomach guard includes power mesh stretched and sewn to provide stomach support. Support bands may connect to the diamond shaped stomach guard to create a supportive relationship between the stomach guard and the connecting bands that stretch and support in proportion to each other. In one embodiment, the diamond shaped stomach guard is sewn with a double stitch pattern with an extra layer of power mesh that is smaller than the other layers of the diamond shaped stomach guard and stretched to provide support.

In one embodiment, the body shaping components includes curved breast shaping material 105 to push and wrap around the breasts at the same time. In one embodiment, the breast shaping material may be composed of a material such as power mesh or other similarly supportive material. In one embodiment, the curved breast shaper includes pouches to insert pads 110 for extra lift or shape if needed. In one embodiment, the bra component may include power mesh cups 115 or similar fabric to mold around the breasts, as well as fabric 120, such as power mesh, around the back portion of the garment to reduce and smooth bulges caused by bras, sometimes referred to as "back fat".

Cups 125 overlap and are sheered to pull in the breasts as well as lift the breasts, according to one embodiment. An alternative wide band of mesh 130 over the performance fabric may be used in one embodiment to reduce lumps and irregular shaping.

In one embodiment, right and left diamond bands 135 are angled to draw in the under bust creating a small waist and coming into a point with the strength of the power mesh as well as performance fabric tightening the waist line. Right and left bands 140 may be attached to the center of the diamond to reduce and smooth the hips targeting the "love handles", in one embodiment. Right and left bands 145 may attach to the bottom of the diamond shaped stomach guard, in one embodiment, and angled in order to support the buttocks or "saddle bags". In one embodiment, bands may range from narrow to wide 150 according to the distance from the center of the back and the diamond shaped stomach guard in order to provide a smooth, elegantly shaped contour that differs from that of the prior art.

Fabric used in the garment may be made of 1 or more layers 155 of performance fabric to smooth out the overall shape of the wearer. In addition to the base fabric, power mesh may be used, particularly for the bands, to help in the shaping of the garment. In one embodiment, the straps 160 may range in shape from narrow to wide at the shoulders to increase comfort and stability, particularly helpful for larger breasted women. In one embodiment, the back is supported by bands 165 just below the shoulder blades to reduce bulge and "fat back". Furthermore, the back bra 170 may be angled and contoured to create a leaner, more feminine back while acting as a support for the front lift. In one embodiment, the right and left top band 175 contours the upper back to shape the waist from the top, which is a contour trick to make the waist appear slimmer. The right and left middle bands 180 shape and press in the stomach as well as support the hips, in one embodiment.

In one embodiment, the bottom band 185 dips and curves from a wide to a narrow shape to carry on the shape of the buttocks and lift as it pulls. Lingerie "sticky tape" 190 is cover stitched, in one embodiment, to the bottom to prevent the body shaper from sliding up. In one embodiment, a back zipper 195 may be used for easy access without having to pull the garment over the head to put on or remove the garment. In one embodiment, hook and eye top 200 is added for security and to add to the elegance of the garment when worn under certain dresses. And finally, zigzag stitching 210 may be used to increase strength, durability, and flexibility, according to one embodiment, as well as vintage aesthetic appeal.

Figures 2A, 2B, 2C:
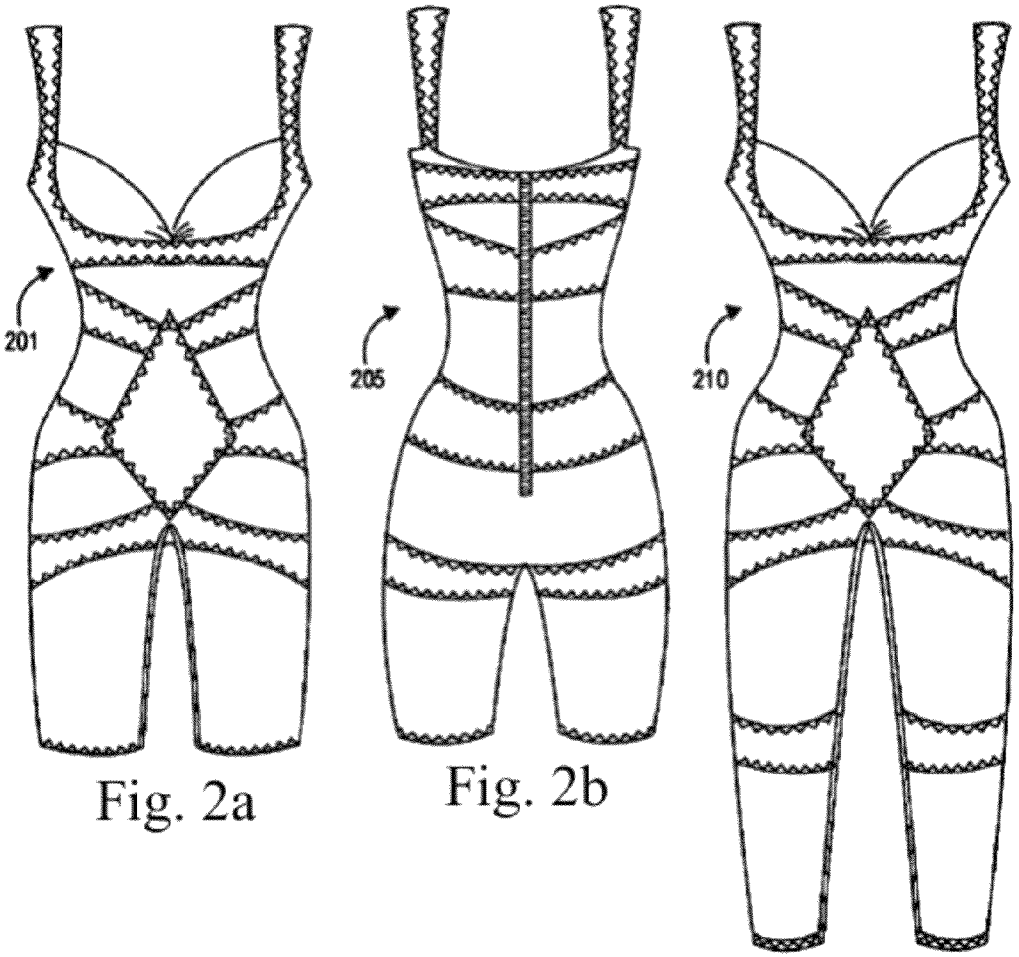
FIGS. 2*a*-2*c* illustrate a garment according to one embodiment.
Figures 3A, 3B, 3C:
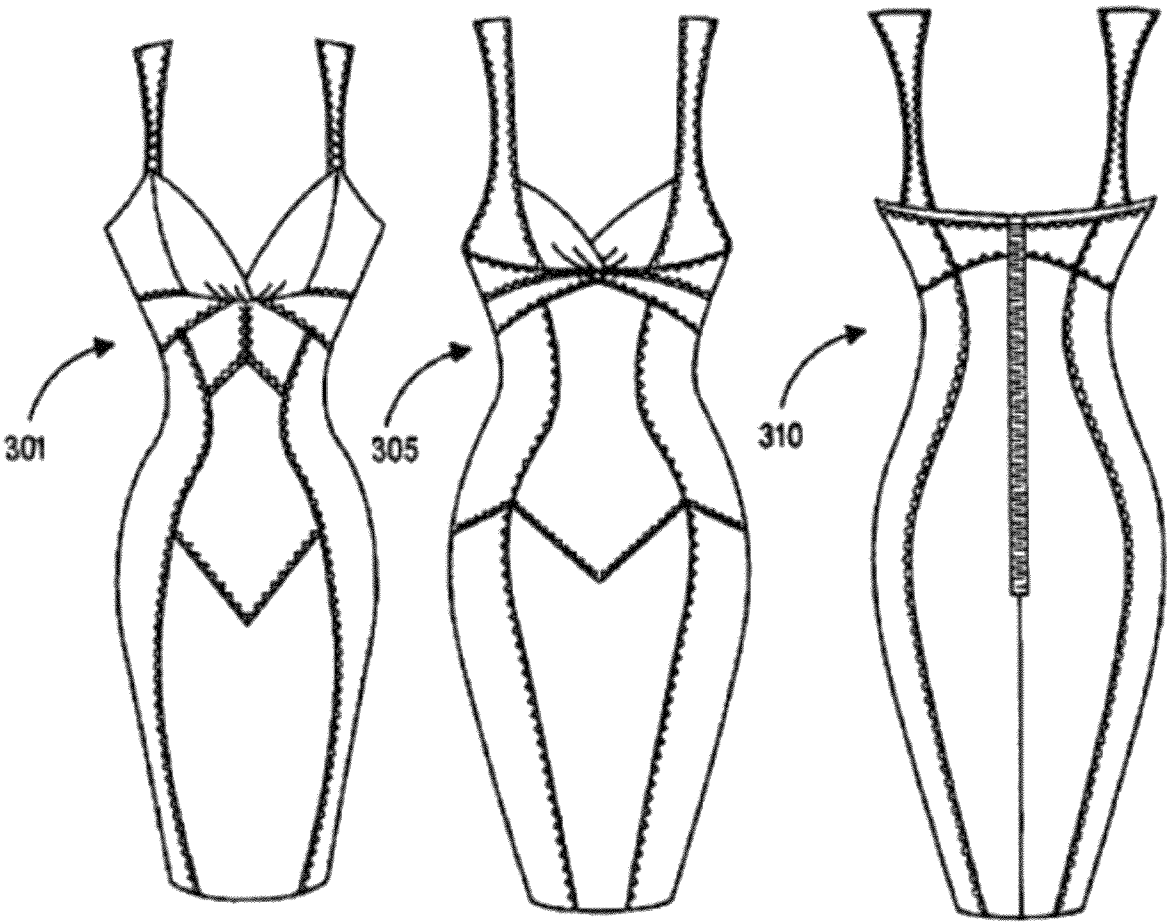
FIGS. 3*a*-3*e* illustrate a garment according to one embodiment.
Figure 3D:
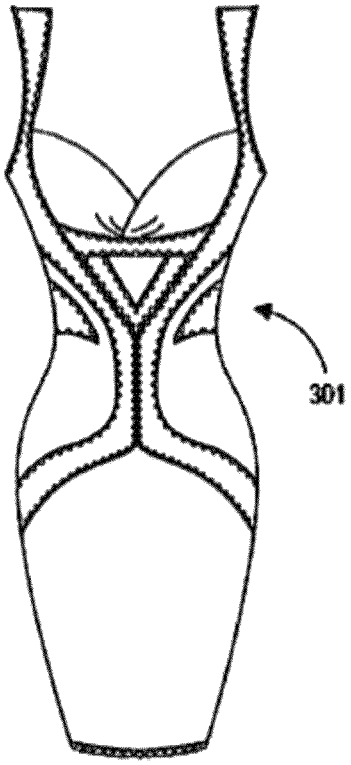
Figure 3E:
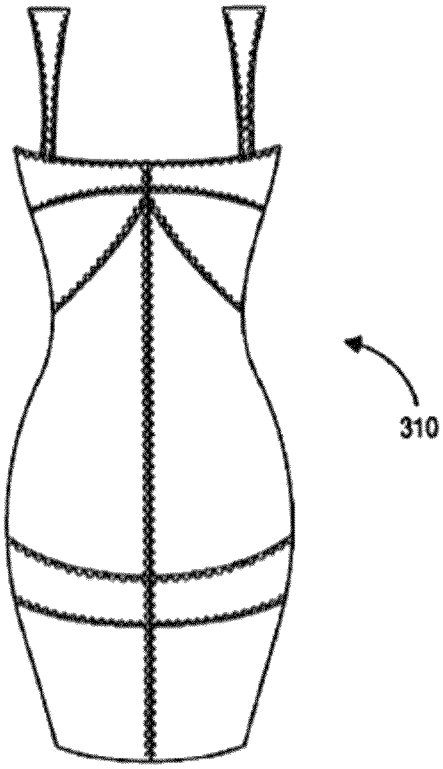

FIGS. 2*a*-2*c* illustrate a slip-shaped garment according to one embodiment, which uses pant legs (or partial pant legs) instead of a skirt portion. Particularly, 201 shows a front view of a partial pant leg version and 205 shows a rear view. In one embodiment, the pant legs may be longer, such as in 210.

FIGS. 3*a*-3*e* illustrate a slip-shaped garment according to one embodiment that uses an alternative bandings and stomach support configurations. Particularly, 301 and 305 show a front view of a garment according to one embodiment, while 310 shows a rear view.

Figure 4B:
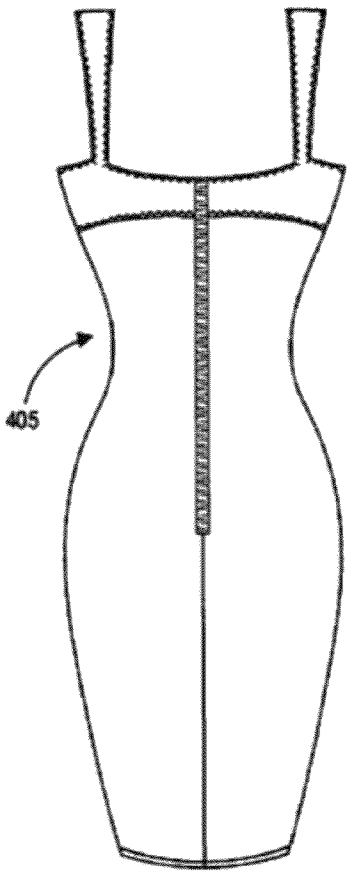
FIG. 4*b* illustrates a garment according to one embodiment.
Figure 4A:
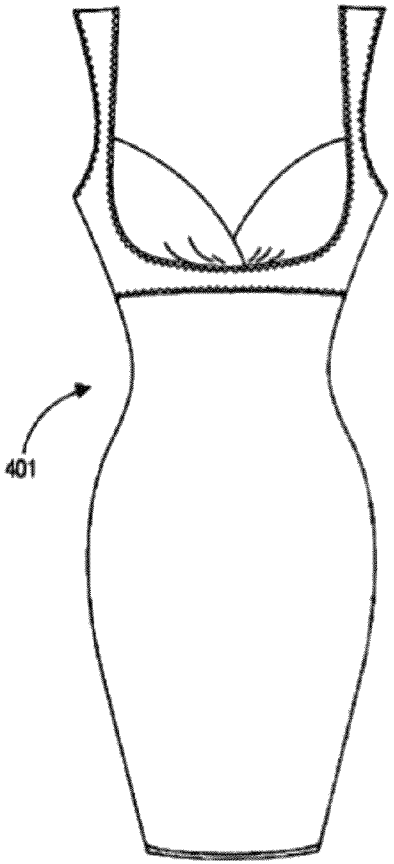
FIG. 4*a* illustrates a garment according to one embodiment.

FIGS. 4*a*-4*b* illustrate a slip-shaped garment according to one embodiment that uses yet another alternative banding and stomach support configuration. Particularly, 401 shows a front view of the garment, according to one embodiment, whereas 405 shows a rear view.

Figure 5:
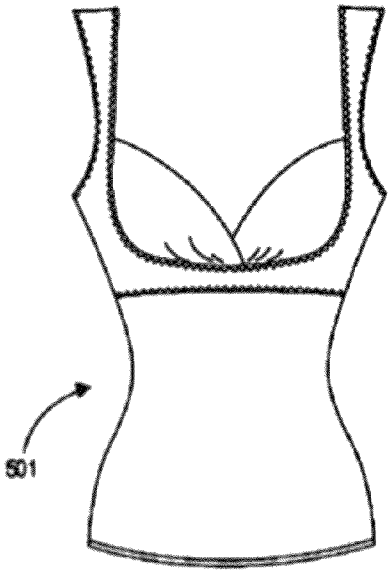
FIG. 5 illustrates a garment according to one embodiment.

FIG. 5 illustrates a slip-shaped garment according to one embodiment that uses only a bra-area banding configuration. Particularly, 501 shows a front view of the garment, according to one embodiment.

Figure 6A:
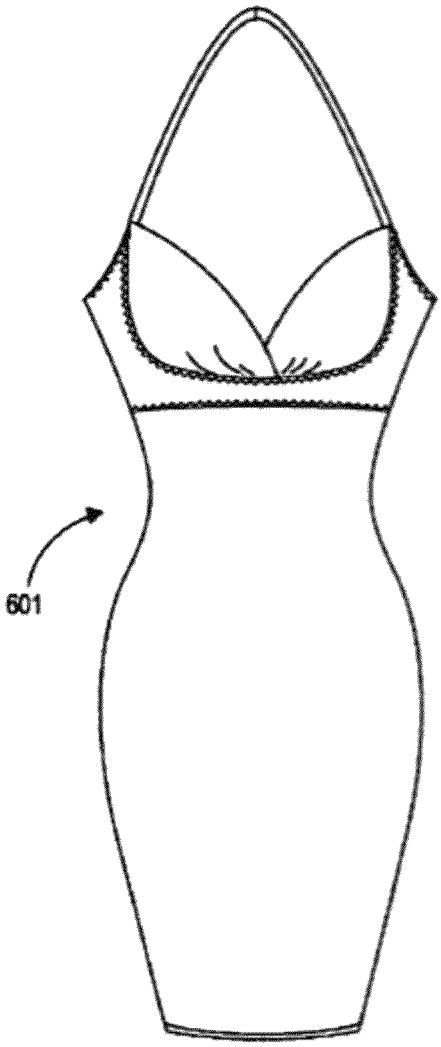
FIGS. 6*a*-6*b* illustrate a garment according to one embodiment.
Figure 6B:
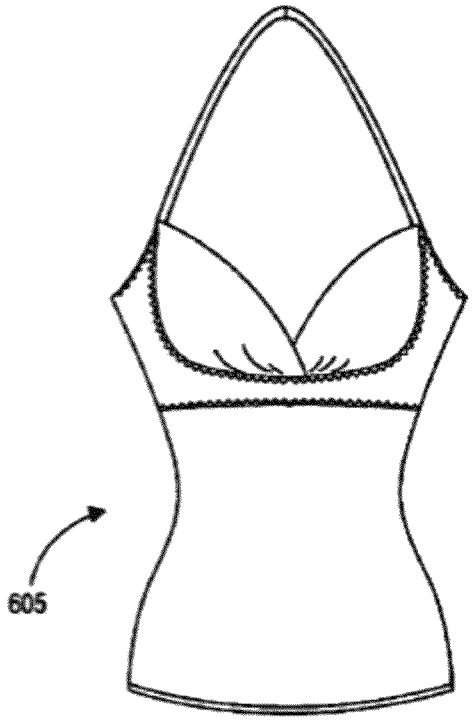

FIGS. 6*a*-6*b* illustrate a slip-shaped garment according to one embodiment that uses an alternative strap configuration. Particularly, 601 shows a front view of the garment, according to one embodiment, whereas 605 shows a rear view.

Figure 7A:
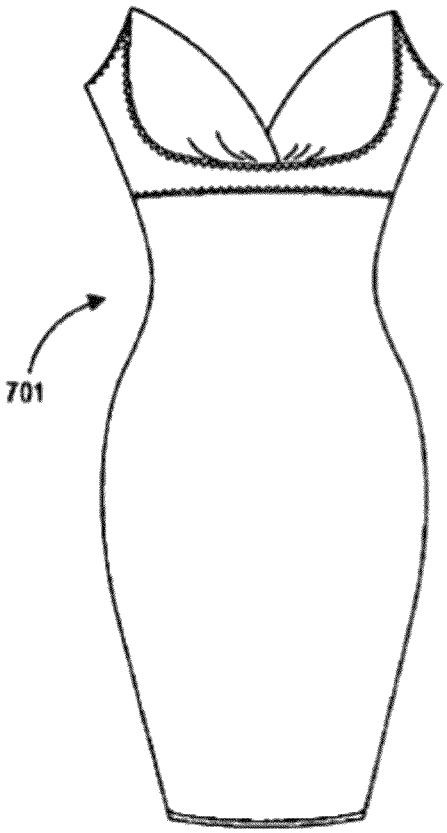
FIGS. 7*a*-7*b* illustrate a garment according to one embodiment.
Figure 7B:
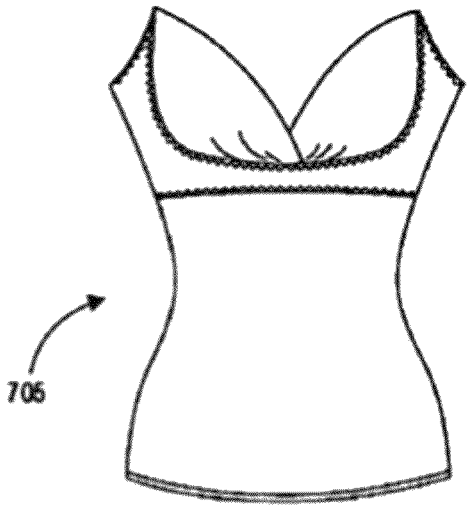

FIGS. 7*a*-7*b* illustrate a slip-shaped garment according to one embodiment that omits that straps. Particularly, 701 shows a front view of the garment, according to one embodiment, whereas 705 shows a rear view.

Figure 8A:
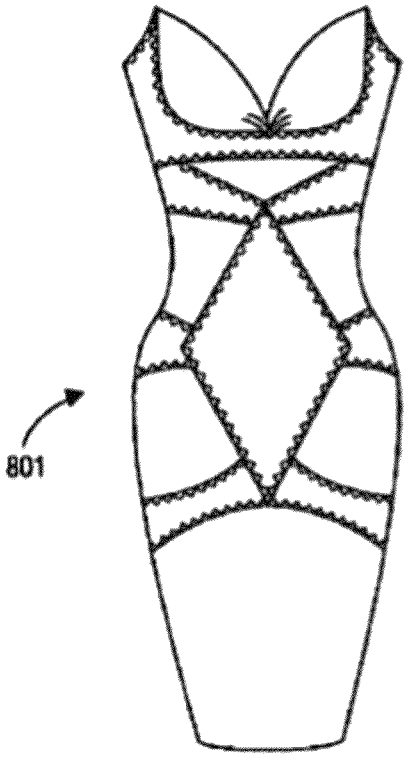
FIGS. 8*a*-8*b* illustrate a garment according to one embodiment.
Figure 8B:
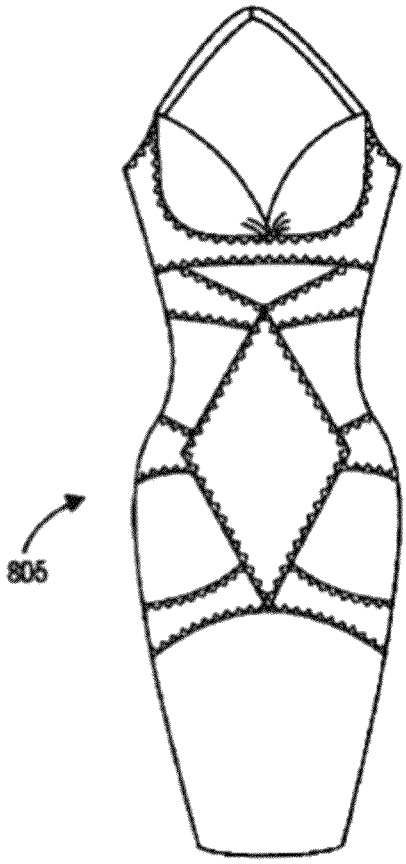

FIGS. 8*a*-8*b* illustrate a slip-shaped garment according to one embodiment that includes two alternative strap configurations. Particularly, 801 shows a front view of one embodiment that omits that straps, whereas 805 illustrates a front view of an embodiment that includes a connected "v"-shaped strap configuration.

Figure 9A:
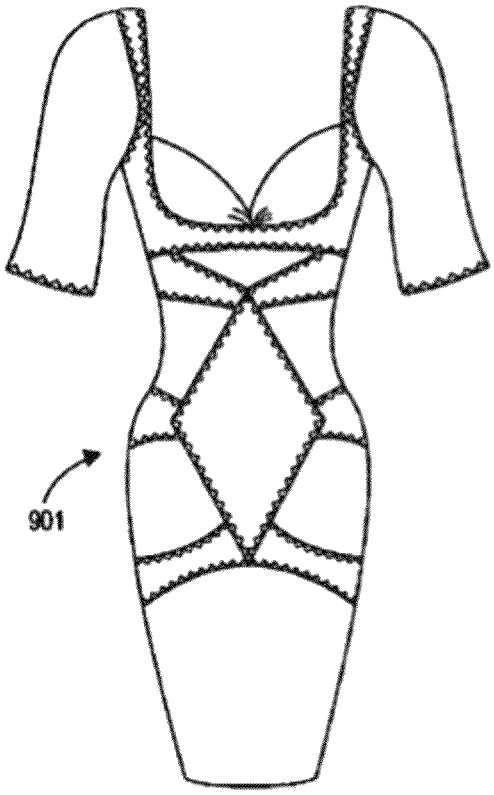
FIGS. 9*a*-9*b* illustrate a garment according to one embodiment.
Figure 9B:
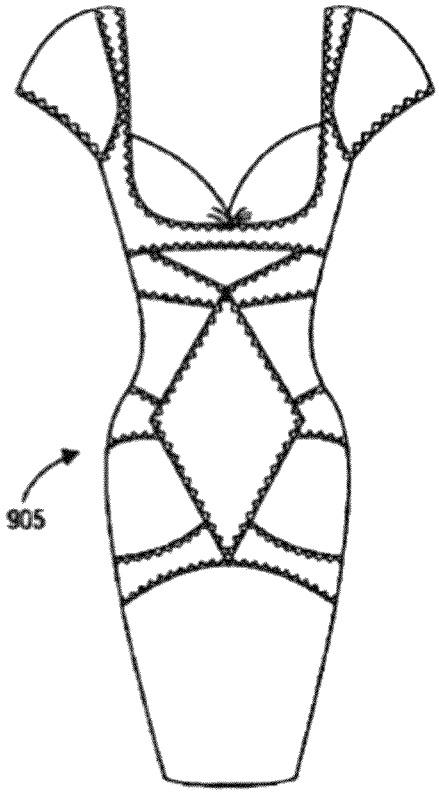

FIGS. 9*a*-9*b* illustrate a slip-shaped garment according to one embodiment that includes sleeves. Particularly, 901 illustrates a half-length sleeve garment, according to one embodiment, whereas 905 illustrates a short-sleeve garment.

Figure 10A:
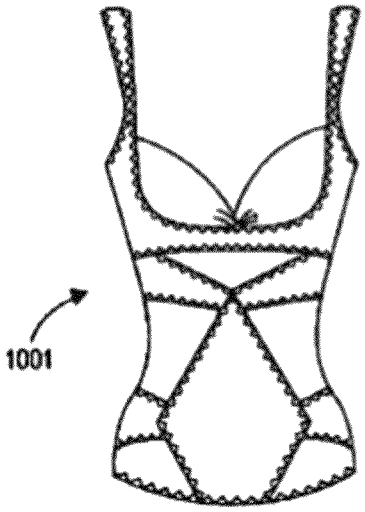
FIGS. 10*a*-10*b* illustrate a garment according to one embodiment.
Figure 10B:
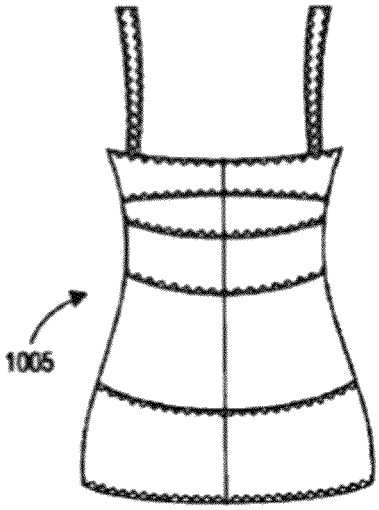

FIGS. 10*a*-10*b* illustrate a slip-shaped garment according to one embodiment that is short in length. Particularly, 1001 shows a front view of the garment, according to one embodiment, whereas 1005 shows a rear view.

Figure 11:
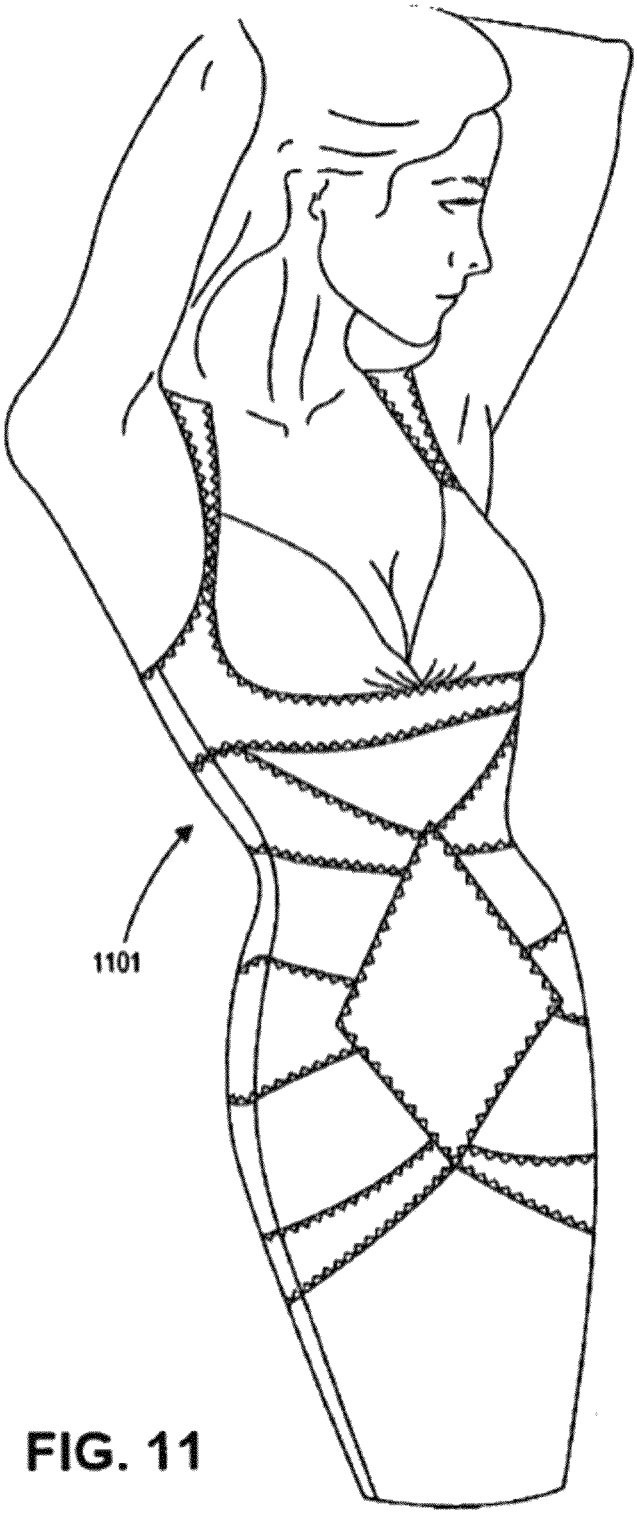
FIG. 11 illustrates a garment on a female body, according to one embodiment.

FIG. 11 illustrates a slip-shaped garment, according to one embodiment, on a female body. The garment 1101 serves to shape and contour the woman's body in a flattering manner, while serving as an elegant article of lingerie. Embodiments may use other materials than mentioned in the foregoing, as well as different configurations of banding, stomach support, lengths, and sleeve and strap configurations. In one embodiment, the use of banding and stomach support in particularly important areas of the female body serves to create a smooth and contoured female figure while the flexible banding material and construction serves to support the body while stretching and moving with the body in a way that promotes a smooth shape underneath any gown or dress.

Figure 12A:
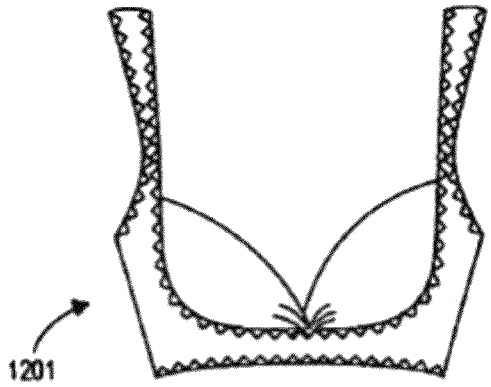
FIGS. 12*a*-12*b* illustrate a garment according to one embodiment.
Figure 12B:
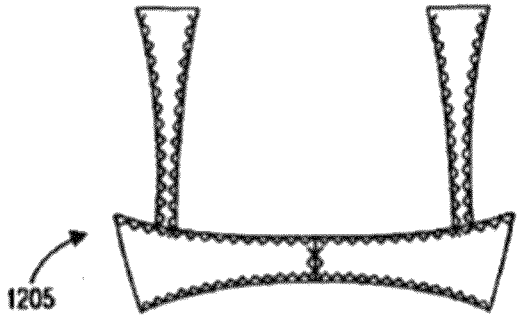
Figure 13:
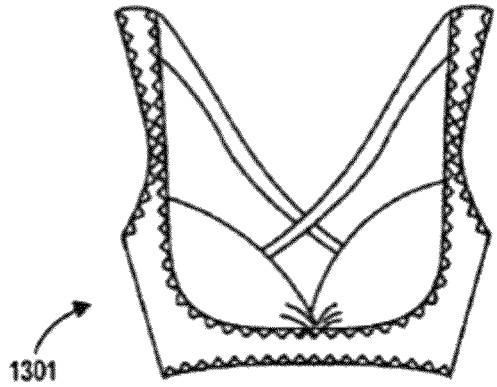
FIG. 13 illustrates a garment according to one embodiment.

FIGS. 12*a*-12*b* illustrate a shaping garment according to one embodiment that includes only a bra. The front view 1201 and rear view 1205 are illustrated in FIG. 12. FIG. 13 illustrates another shaping garment including only a bra 1301, according to another embodiment. The garments of FIGS. 12 and 13 both include shaping material around the breasts.

Figure 14A:
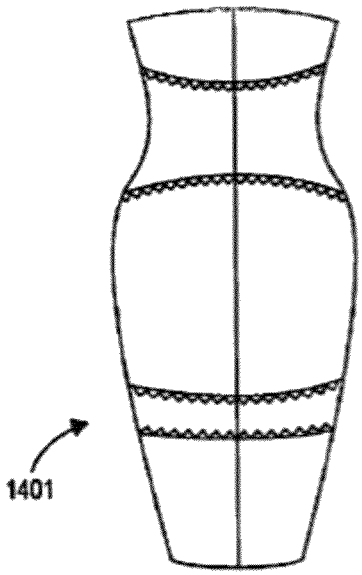
FIGS. 14*a*-14*b* illustrate a garment according to one embodiment.
Figure 14B:
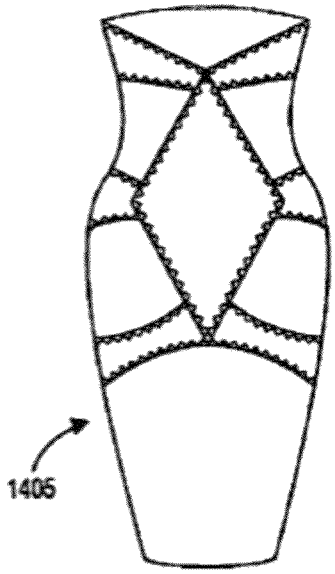
Figure 15A:
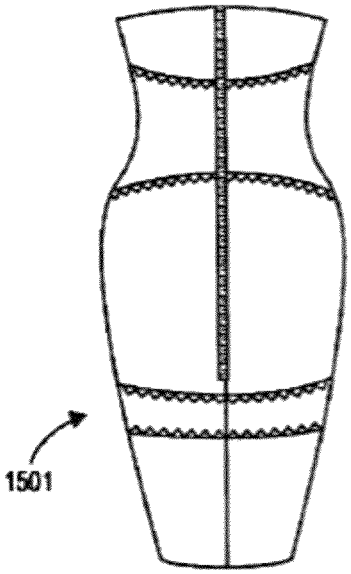
FIGS. 15*a*-15*b* illustrate a garment according to one embodiment.
Figure 15B:
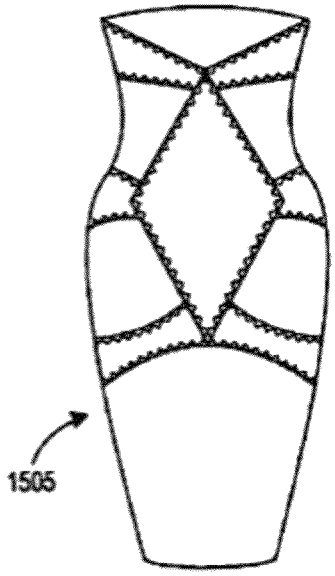

FIGS. 14*a*-14*b* illustrate a garment according to one embodiment that is slip-shaped and omits the shoulder straps. Various shaping patterns are possible including those illustrated in the front view 1405 and rear view 1401. FIG. 15 illustrates a slip-shaped garment without shoulder straps, according another embodiment. In FIGS. 15*a*-15*b*, the rear view 1501 and front view 1505 are illustrated. Other support patterns may be included in slip-shaped strapless garments according to other embodiments.

Figure 16A:
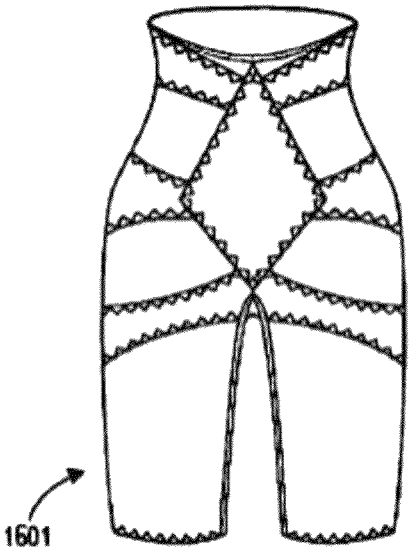
FIGS. 16*a*-16*b* illustrate a garment according to one embodiment.
Figure 16B:
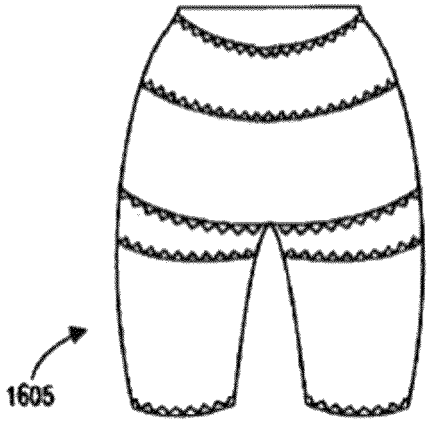

FIGS. 16*a*-16*b* illustrate a garment according to one embodiment having leg supports and offering support for mid-lower torso without offering support for the upper torso or breasts. In 1601, one embodiment is illustrated while 1605 illustrates a different embodiment. Other support patterns are possible in other embodiments using various support materials, such as power mesh.

Thus, embodiments of a slip-shaped garment are disclosed. While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art upon studying this disclosure. In an area of technology such as this, where growth is fast and further advancements are not easily foreseen, the disclosed embodiments may be readily modifiable in arrangement and detail as facilitated by enabling technological advancements without departing from the principles of the present disclosure or the scope of the accompanying claims.

What is claimed is:

1. An undergarment for shaping the human female body comprising:

an upper torso undergarment comprised of:

a stomach support, wherein the stomach support is diamond shaped, stitched to the upper torso undergarment; and at least one band connectively stitched to symmetrically opposite sides of the stomach support, wherein the at least one band is to wrap around the circumference of the upper torso garment to support a particularly area of the human female body;

wherein the at least one band is sewn to the stomach support at the points of the diamond shape, such that the bands create force vectors that provide an hourglass shaping effect using the tension created by the force vectors of the seams.

2. The undergarment of claim 1, further comprising a bra attached to the upper torso undergarment; and two breast cups attached to the bra;

wherein, the bra includes a breast support band coupled to the two breast cups to provide support for and shaping of breasts of the human female body;

wherein, cups overlap in the center of the garment and are rouched to pull in the breasts toward the center of the body as well as lift the breasts;

a crossover of the bra cups in the center of the bra creates tension in the bra cup that pushes breasts together to create cleavage; and a fold at the top of the bra cup allows for expansion and accommodates multiple breast cup sizes without creasing the breasts.

3. The undergarment of claim 2, wherein the breast support band is to wrap around the body in a manner to as to promote a smooth back region around the area supported by the breast support band.

4. The undergarment of claim 2, wherein the breast support band and the at least one band vary in width according to the areas supported by breast support band and the at least one band.

5. The undergarment of claim 4, wherein the breast support band and the at least one band are narrower in a frontal portion of the undergarment than in a rear portion of the undergarment.

6. The undergarment of claim 2, wherein the undergarment is to extend over the thighs of the female human body.

7. The undergarment of claim 2, wherein the undergarment is to extend no further than a buttocks region of the female human body.

8. The undergarment of claim 2, wherein the undergarment is sleeveless.

9. The undergarment of claim 2, wherein the undergarment includes sleeves.

10. The undergarment of claim 2, wherein the undergarment includes straps.

11. The undergarment of claim 2, wherein the undergarment is strapless.

12. The undergarment of claim 2, wherein the two breast cups include pockets for breast shaping inserts.

13. The undergarment of claim 2, wherein the stomach support, the at least one band, and the breast support band are stitched to the undergarment using a zigzag stitch pattern.

14. An undergarment for shaping the human female body comprising:

an upper torso undergarment comprised of:

a bra component, including a breast support band;

a stomach support, wherein the stomach support is diamond shaped;

a first band connectively stitched to symmetrically opposite sides of the stomach support to support the torso of the human female body;

a second band connectively stitched to symmetrically opposite sides of the stomach support to support the lower back region of the human female body; and a third band connectively stitched to symmetrically opposite sides of the stomach support to support the buttocks of the human female body to create a lower torso undergarment section;

wherein the bands are sewn to the stomach support at the points of the diamond shape, such that the bands create force vectors that provide an hourglass shaping effect using the tension created by the force vectors of the bands.

15. The undergarment of claim 14, wherein the stomach support, and the first, second and third band comprise multiple layers of fabric, including at least one layer of power mesh fabric.

16. The undergarment of claim 14, wherein the second band crosses the body at the waist top, high hip and low hip area of the human female body.

17. The undergarment of claim 14, wherein by varying the width of the bands and the angles of the bands as sewn on the panels creates the hourglass shape.

18. The undergarment of claim 17, wherein by varying the width of the bands where the bands are wider on the sides than in the front or rear and changing the angle of each band relative to the body from the front to the side to the rear determines the shaping effect.

* * * * *